US005140865A

United States Patent [19]

Foster

[11] Patent Number: 5,140,865

[45] Date of Patent: Aug. 25, 1992

[54] CONTROL LEVER ASSEMBLY

[75] Inventor: Derek W. Foster, Littleover, United Kingdom

[73] Assignee: J. C. Bamford Excavators Limited, United Kingdom

[21] Appl. No.: 623,411

[22] PCT Filed: Apr. 26, 1990

[86] PCT No.: PCT/GB90/00657

§ 371 Date: Dec. 6, 1990

§ 102(e) Date: Dec. 6, 1990

[87] PCT Pub. No.: WO90/13863

PCT Pub. Date: Nov. 15, 1990

[30] Foreign Application Priority Data

Apr. 29, 1989 [GB] United Kingdom ..... 8909955

[51] Int. Cl.[5] ..... G05G 9/02

[52] U.S. Cl. ..... 74/471 XY; 74/491; 137/636.2; 37/117.5; 37/118 R

[58] Field of Search ..... 74/471 XY, 471 R, 491, 74/519; 137/636.2; 37/117.5, 118 R, D3

[56] References Cited

U.S. PATENT DOCUMENTS

| | | | |
|---|---|---|---|
| 3,338,269 | 8/1967 | Carbert et al. | 74/471 R |
| 3,517,790 | 6/1970 | Damon | 74/471 R |
| 4,169,443 | 10/1979 | Todeschini | 74/471 XY |
| 4,389,151 | 6/1983 | Brown | 74/471 XY |
| 4,489,805 | 12/1984 | Okage | 74/471 XY |
| 4,526,204 | 7/1985 | Primdahl | 74/471 XY |
| 4,541,497 | 9/1985 | Riediger et al. | 74/471 R |
| 4,736,647 | 4/1988 | Shimoie et al. | 74/471 R |

FOREIGN PATENT DOCUMENTS

| | | | |
|---|---|---|---|
| 0015585 | 1/1989 | Japan | 137/636.2 |
| 2085131 | 4/1982 | United Kingdom . | |

*Primary Examiner*—Leslie A. Braun
*Assistant Examiner*—Winnie Yip
*Attorney, Agent, or Firm*—Varnum, Riddering, Schmidt & Howlett

[57] ABSTRACT

A control lever assembly e.g. for controlling hydraulic valves in an excavating and/or loading vehicle (10) includes first and second control levers (34, 35) the first control lever (34) being mounted for movement about first and second transverse axes, (45, 47) movement of the first lever (34) about the first axis (45) operating a first function, and movement of the first lever (34) about the second axis (47) operating a second function, and a second control lever (35) mounted for movement about a third axis (56) generally coincident with or parallel to the first axis (45) movement of the second lever (35) about the third axis (56) operating a third function, the first lever (34) being generally rigid with a mounting member (37) and the second lever (35) being movably mounted on the mounting member (37) whereby upon movement of the first lever (34) about the second axis (47) the second lever (35) is carried by the mounting member (37) so that the third axis (56) remains generally coincident with or parallel to the first axis.

11 Claims, 3 Drawing Sheets

CONTROL LEVER ASSEMBLY

BACKGROUND OF THE INVENTION

1. Field of the Invention

This invention relates to a control lever assembly and more particularly, but not exclusively, to a control lever assembly for controlling hydraulic valves in an excavating and/or loading vehicle.

2. Description of the Related Art

A control lever assembly is known for controlling three functions in such a manner that either one of a pair of control levers can be used to control a particular one of the three functions, for example as described in previous patent application GB 2085131.

SUMMARY OF THE INVENTION

It is one object of the present invention to provide a new or improved control lever assembly.

According to one aspect of the present invention we provide a control lever assembly including first and second control levers, the first control lever being mounted for movement about first and second transverse axes, movement of the first lever about the first axis operating a first function, and movement of the first lever about the second axis operating a second function, and a second control lever mounted for movement about a third axis generally coincident with or parallel to the first axis, movement of the second lever about the third axis operating a third function, the first lever being generally rigid with a mounting member and the second lever being movably mounted on the mounting member whereby upon movement of the first lever about the second axis, the second lever is carried by the mounting member so that the third axis remains generally coincident with or parallel to the first axis.

With such a construction an operator may always operate both the first and second levers simultaneously with one hand provided that the graspable portion of the second lever is mounted within reach of the graspable portion of the first lever because the spacial relationship between the two graspable portions of the levers remains substantially constant when the first lever is moved about the second axis.

According to a second aspect of the invention we provide an excavating/loading vehicle having three functions controlled by a control lever assembly according to the first aspect of the invention.

BRIEF DESCRIPTION OF THE DRAWINGS

The invention will now be described with reference to the accompanying drawings, in which.

Figure 1:
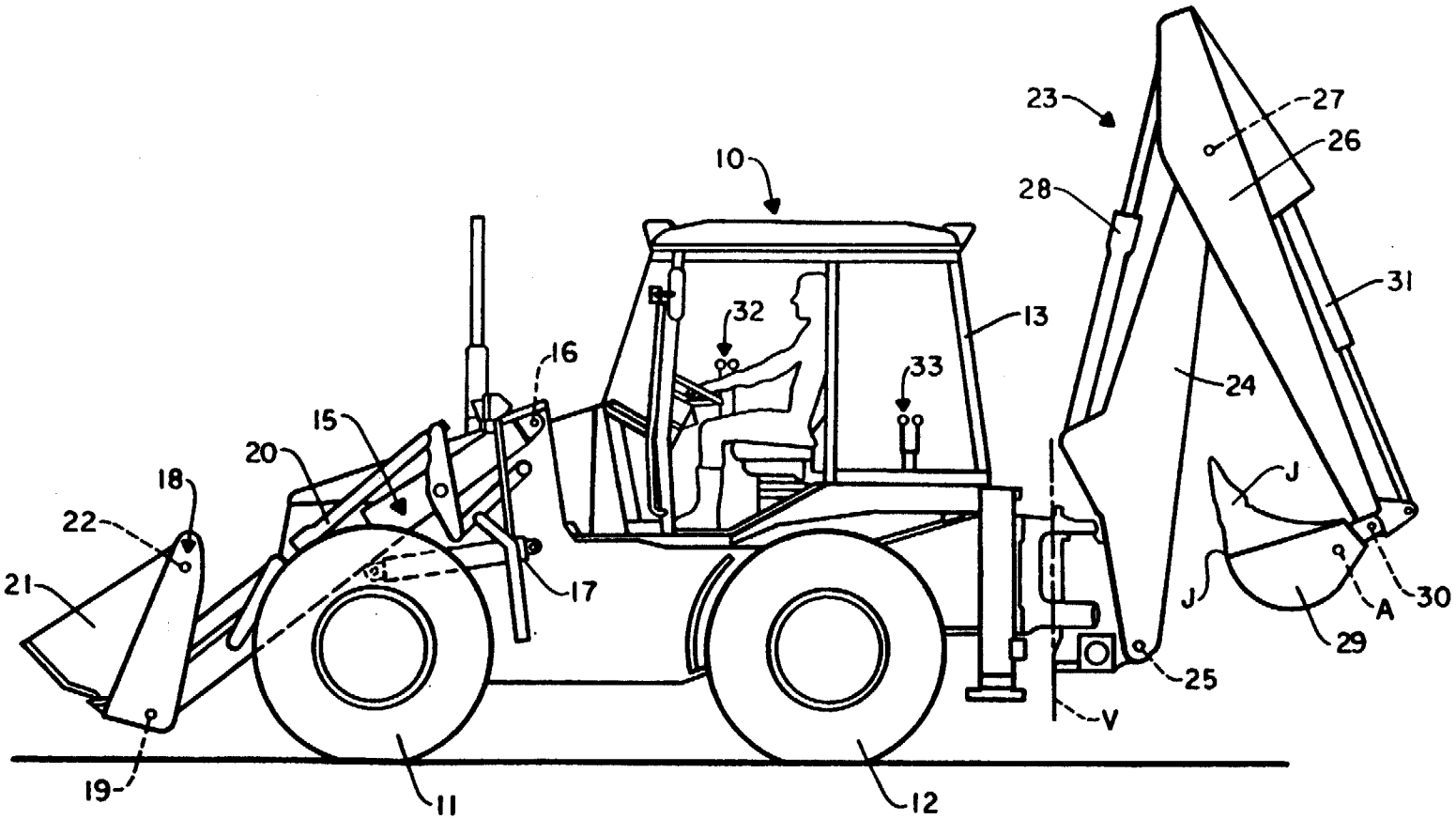
FIG. 1 is a side illustrative view of a vehicle having a control lever assembly in accordance with the invention.

Referring first to FIG. 1 of the drawings, a combined loading and excavating vehicle comprises a body 10 having two pairs of ground wheels 11 and 12 and an operator's cab 13. At the front of the vehicle a loading arm 15 is provided which is movable about a first horizontal axis 16 by a pair of hydraulic rams 17 (only one of which is seen), and a bucket 18 is mounted for movement about a second horizontal axis 19 on the boom 15 via one or more hydraulic rams 20. The bucket 18 has a front jaw section 21 which is movable by another hydraulic ram (not seen) for movement about a third horizontal axis 22.

At the rear of the vehicle, an excavating arm 23 is provided which comprises a boom 24 mounted for movement about a vertical axis V on the body 10 of the vehicle, by one or more hydraulic rams (not seen), and movement relative to the body 10 about a first generally horizontal axis 25.

A dipper arm 26 is pivotally mounted on the boom 24 for movement about a second generally horizontal axis 27 via hydraulic ram 28 and a bucket 29 is mounted on the dipper 26 for movement about a third generally horizontal axis 30 by a ram 31.

The bucket 29 includes a jaw section J which is pivotal relative to the bucket 29 by a further ram (not seen) for movement about a fourth generally horizontal axis A.

The various hydraulic rams which actuate movement of loading arm 15, bucket 18 and jaw 21 are controlled by hydraulic valves operated by a first twin control lever assembly 32 and the hydraulic rams which actuate movement of the dipper arm 26, bucket 29, and bucket jaw J, are controlled by hydraulic valves operated by a second control lever assembly 33.

Figure 3:
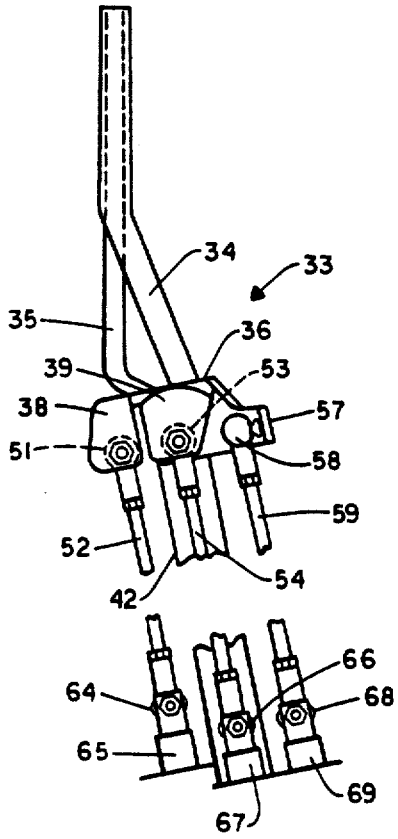
FIG. 3 is a side view of the control lever assembly of FIG. 2, and, FIG. 4 is a perspective view of the control lever assembly of FIGS. 2 and 3.
Figure 4:
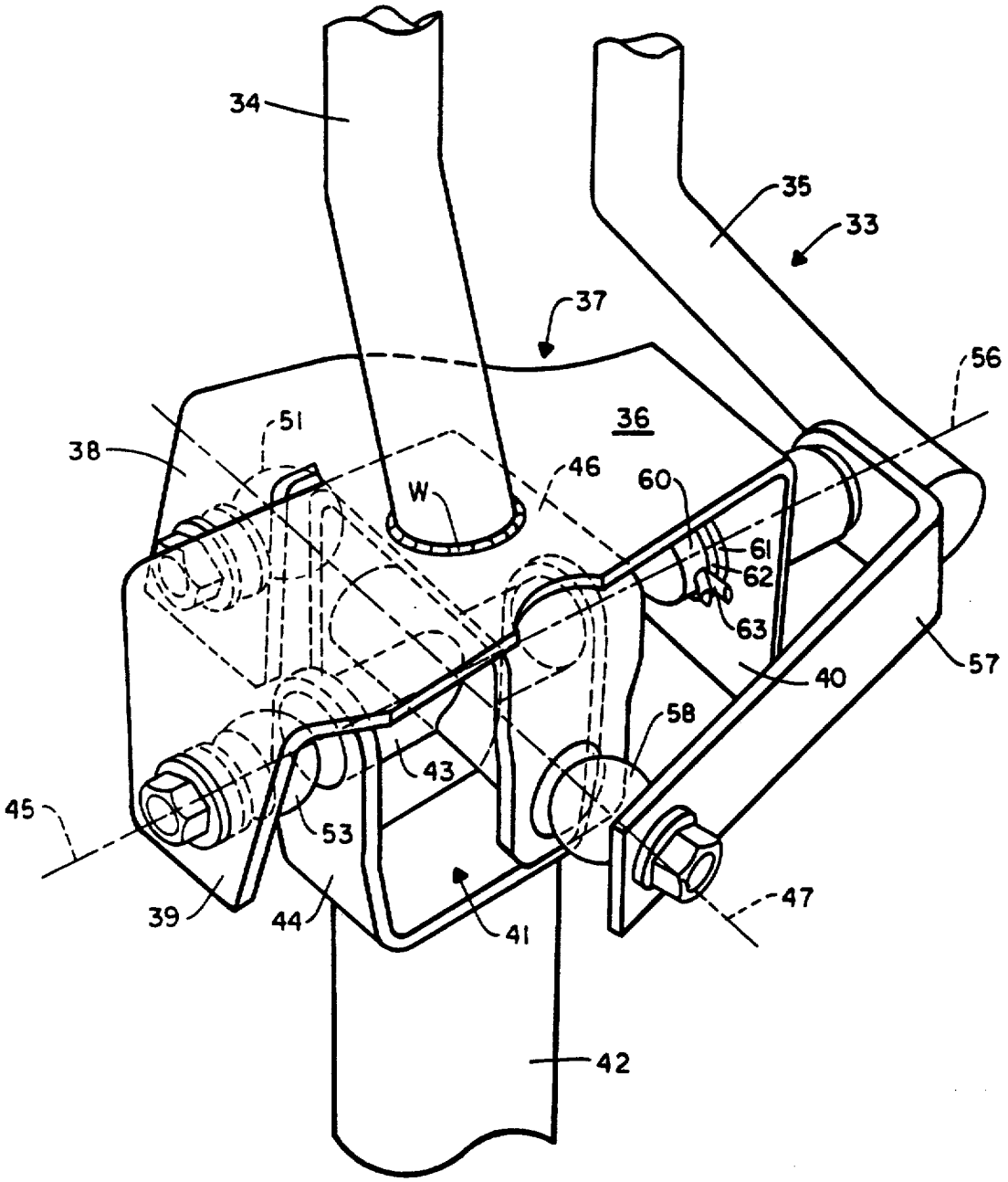

The control lever assemblies 32 and 33 are substantially identical and hence only control lever assembly 33 will be described in more detail with reference to FIGS. 2 to 4.

Control lever assembly 33 comprises a first, main, control lever 34 and a second, auxiliary, control lever 35.

The first lever 34 is rigid e.g. secured by welding W or otherwise, integrally formed, relative to a web 36 of a mounting member 37, there being formed with the web 36 first, second and third transverse limbs 38, 39 and 40, which limbs extend from the web 36 in a generally opposite direction to the first lever 34.

The mounting member 37 is carried via a universal joint assembly 41 on a support 42 secured to the body 10 of the vehicle.

The universal joint assembly 41 comprises a generally cruciform part 43, a first clevis 44 rigid with the support 42 e.g. bolted or welded thereto, the cruciform part 43 being rotatable relative to clevis 44 about a first axis 45 and a second clevis 46 being rotatable relative to the cruciform port 43 about a second axis 47, the second clevis 46 being rigidly attached to the mounting member 37, e.g. by bolting or welding.

Universal joint assemblies 41 are well known and further description is not considered necessary.

The first limb 38 of the mounting member 37 is connected via a ball joint 51 to a first operating arm 52 (not shown in FIGS. 2, or 4 for clarity) which arm 52 is moved up and down as the lever 34 is moved about the first axis 45 on the mounting member 37.

The second limb 39 is connected via a ball joint 53 to a second operating arm 54 (again not shown in FIGS. 2, and 4) which is moved up and down as the lever 34 is moved about the second axis 47).

The third limb 40 carries a mounting means for the second lever 35, which second lever 35 can move relative to the mounting member 37 about a third axis 56 which, in the present example, is generally coincident with the first axis 45 but may be only parallel to the first axis 45 if desired.

Rigidly secured to the auxiliary lever 35 is a linkage 57 which extends to the side of the mounting member 37 and is connected via a ball joint 58 to a third operating arm 59 (not shown in FIGS. 2 and 4) such that the operating arm 59 is moved up and down as the lever 35 is moved about a pivotal axis 56.

It can be seen that ball joint 53 is centered on the first axis 45, and that each of the ball joints 51 and 58 are centered on the second axis 47.

Thus movement of the lever 34 about the first axis 45 does not cause any appreciable movement of the operating arm 54 because ball joint 53 is centered on the axis 45, and because lever 35 is free to rotate about axis 56, movement of mounting member 37 about axis 45 is not transmitted to operating arm 59. Movement of the lever 34 about the second axis 47 does not cause any appreciable movement of the operating arms 52 and 59 because the ball joints 51, 58 are centered on axis 47, and movement of the lever 35 about axis 56 does not cause any appreciable movement of the operating arms 52 and 54 because its movement is not transmitted to the mounting member 37.

The mounting of the lever 35 to the mounting member 37 in this example comprises an axle 60 which is rigid with the lever 35, and is received in an opening 61 in the limb 40 of the mounting member 37, there being a washer 62 and split pin 63 to provide the pivotal mounting. Any other alternative type of mounting means to enable the lever 35 to pivot about axis 56 relative to the mounting member 37 could alternatively be provided.

For example, a stub axle could be provided on limb 40 of the mounting member 37, which axle engages with the linkage 57 or the lever 35, to provide the pivotal mounting.

In the example of the drawings, the operating arm 52 is connected via a further ball joint 64 (or alternatively a clevis assembly) to an actuating mechanism 65 of a first hydraulic valve, whilst the operating arm 54 is connected via a further ball joint 66 (or alternatively a clevis assembly) to a further actuating mechanism 67 of a further hydraulic valve, and operating arm 59 is connected via a still further ball joint 68 (or alternatively a clevis assembly) to a still further actuating mechanism 69 of a hydraulic valve, the hydraulic valves being those necessary respectively to control the hydraulic rams which move the loading arm 15 relative to the body of the vehicle 10 about axis 16 and move the bucket 18 relative to the arm 15 about axis 19 and move the bucket jaw 21 relative to the bucket about axis 22.

Figure 2:
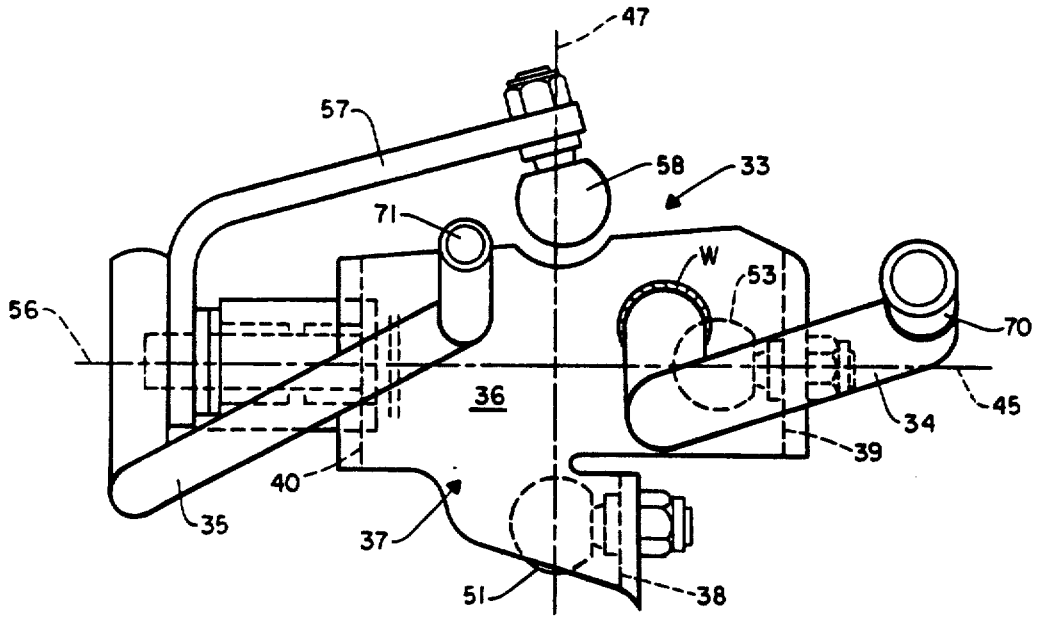
FIG. 2 is a plan view of a control lever assembly in accordance with the invention.

It can be seen from FIG. 2 that each of the levers 34 and 35 have a respective manually graspable portion 70 and 71. The levers 34, 35 are constructed i.e. bent to shape, so that the manually graspable portions 70 and 71 are within a hands reach of one another.

Thus an operator in the cab 13 of the vehicle may actuate any one, two or three functions of the loading arm 15 using one hand only.

As mentioned above, the rams which operate the dipper 26, bucket 29, and jaw J of the excavating arm 23, are also controlled by a substantially identical control lever assembly 33 to that described, in which case again, any one, two or three functions of the excavating arm 33 may be controlled by an operator using one hand only spanning the two levers 34 and 35.

For example, movement of the operating lever 52 may control rams which cause the dipper arm 26 movement relative to the boom 24, and movement of the operating lever 54 may control the rams which cause movement of the bucket 29 relative to the dipper 26, and movement of the operating lever 59 may control the rams which cause the bucket jaw J movement relative to the bucket 29.

Although as described the invention has been specifically described for use in controlling actuating mechanisms for operating hydraulic valves in a hydraulic circuit of a combined loading and excavating vehicle, the invention could of course be applied to a control lever assembly for use in controlling any other three functions as required.

The features disclosed in the foregoing description or the accompanying drawings, expressed in their specific forms or in terms of a means for performing the disclosed function, or a method or process for attaining the disclosed result, or a class or group of substances or compositions, as appropriate, may, separately or in any combination of such features, be utilized for realizing the invention in diverse forms thereof.

I claim:

1. A control lever assembly including first and second control levers, means mounting the first control lever for movement about first and second transverse axes, movement of the first lever about the first axis operating a first function, and movement of the first lever about the second axis operating a second function, and means mounting the second control lever for movement about a third axis, the third axis being one of generally coincident and parallel to the first axis, movement of the second lever about the third axis operating a third function, the means mounting the first lever comprising a mounting member with which the first lever is generally rigid and the second lever being movably mounted on the mounting member whereby upon movement of the first lever about the second axis, the second lever is carried about the second axis by the mounting member.

2. An assembly according to claim 1 wherein the first and second axes are generally mutually perpendicular.

3. An assembly according to claim 2 wherein the mounting member is mounted on a support via a universal joint which permits movement of the mounting member about the first and second axes.

4. An assembly according to claim 1 wherein the mounting member comprises a web having first, second and third transverse limbs with the first lever secured to the web and the first, second and third limbs extending from the web in an opposite direction to the first lever, the first of the limbs being connected to a first operating arm which is moved as the first lever is moved about the first axis to achieve the first function and the second of the limbs being connected to a second operating arm which is moved as the first lever is moved about the second axis to achieve the second function and the third limb providing mounting means for the second lever.

5. An assembly according to claim 4 wherein the second lever has rigidly secured thereto a linkage which is connected to a third operating arm so that movement of the second lever about the third axis achieves the third function.

6. An assembly according to claim 5 wherein the first, second and third limbs are connected to their respective operating arms, via ball joints, the centre of a ball joint of the first limb being aligned with the second axis and the centre of a ball joint of the second limb being aligned with the first axis and the centre of the ball joint of the linkage secured to the second lever being aligned with the second axis.

7. An assembly according to claim 5 wherein each of the first, second and third operating arms are connected to an associated actuating mechanism which is operated by the control lever assembly.

8. An assembly according to claim 7 wherein the actuating mechanisms each comprise a respective valve member of a hydraulic valve, which valves operate different functions in an excavating/loading vehicle.

9. An excavating/loading vehicle having three functions controlled by a control lever assembly including first and second control levers, means mounting the first control lever for movement about first and second transverse axes, movement of the first lever about the first axis operating a first function, and movement of the first lever about the second axis operating a second function, and means mounting the second control lever for movement about a third axis, the third axis being one of generally coincident and parallel to the first axis, movement of the second lever about the third axis operating a third function, the means mounting the first lever comprising a mounting member with which the first lever is generally rigid and the second lever being movably mounted on the mounting member whereby upon movement of the first lever about the second axis, the second lever is carried about the second axis by the mounting member.

10. A vehicle according to claim 9 further comprising a boom mounted for movement about a first generally horizontal axis relative to a body of the vehicle, a dipper arm pivoted to the boom for movement about a second generally horizontal axis, an excavating bucket pivoted to the dipper arm for movement about a third generally horizontal axis, and a bucket jaw pivoted to the bucket for movement about a fourth generally horizontal axis, the first function controlled by the first lever being the dipper arm movement relative to the boom of the vehicle, the second function controlled by the first lever being movement of the bucket relative to the dipper arm, and the third function controlled by the second lever being the bucket jaw movement relative to the bucket.

11. A vehicle according to claim 9 wherein the vehicle comprises a loading arm which is movable about a first generally horizontal axis relative to a body of the vehicle, a bucket pivoted to the loading arm for movement about a second generally horizontal axis, and a bucket jaw movable relative to the bucket about a third generally horizontal axis, the first function controlled by the first lever being the loading arm movement relative to the body of the vehicle, the second function controlled by the first lever being movement of the bucket relative to the loading arm, and the third function controlled by the second lever being bucket jaw movement relative to the bucket.

* * * * *